US011302254B2

(12) United States Patent
Cao et al.

(10) Patent No.: US 11,302,254 B2
(45) Date of Patent: Apr. 12, 2022

(54) PIXEL CIRCUIT COMPENSATION METHOD AND DEVICE, AND DISPLAY DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Chun Cao, Beijing (CN); Song Meng, Beijing (CN); Min He, Beijing (CN)

(73) Assignees: HEFEI XINSHENG OPTOELECTRONICS TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/044,249

(22) PCT Filed: Apr. 14, 2020

(86) PCT No.: PCT/CN2020/084645
§ 371 (c)(1),
(2) Date: Sep. 30, 2020

(87) PCT Pub. No.: WO2020/259005
PCT Pub. Date: Dec. 30, 2020

(65) Prior Publication Data

US 2021/0272519 A1 Sep. 2, 2021

(30) Foreign Application Priority Data

Jun. 24, 2019 (CN) ..... 201910548785.9

(51) Int. Cl.
*G09G 3/3258* (2016.01)

(52) U.S. Cl.
CPC ... *G09G 3/3258* (2013.01); *G09G 2300/0842* (2013.01)

(58) Field of Classification Search
CPC combination set(s) only.
See application file for complete search history.

(56) References Cited

U.S. PATENT DOCUMENTS

2006/0050029 A1 3/2006 Toyoda et al.
2013/0169699 A1 7/2013 Jeong et al.
(Continued)

FOREIGN PATENT DOCUMENTS

CN 103187021 A 7/2013
CN 104700772 A 6/2015
(Continued)

OTHER PUBLICATIONS

State Intellectual Property Office of the People's Republic of China, Office Action and Search Report Issued in Application No. 201910548785.9, dated Jun. 3, 2020, 15 pages. (Submitted with Partial Translation).
(Continued)

*Primary Examiner* — Van N Chow
(74) *Attorney, Agent, or Firm* — McCoy Russell LLP

(57) ABSTRACT

The present disclosure discloses a pixel circuit compensation method and device, and a display device. The method includes: when the display panel is in a preset display state, sensing a preset mobility compensation value corresponding to a driving transistor in the pixel circuit; according to the preset mobility compensation value, adjusting an initial mobility compensation value corresponding to the driving transistor to a target mobility compensation value, wherein a difference between the target mobility compensation value and the preset mobility compensation value is less than a threshold; based on the target mobility compensation value,
(Continued)

when the display panel is in a non-display state, compensating a mobility of the driving transistor in a preset compensation manner.

17 Claims, 1 Drawing Sheet

(56) References Cited

U.S. PATENT DOCUMENTS

| | | | | |
|---|---|---|---|---|
| 2015/0154908 | A1 | 6/2015 | Nam et al. | |
| 2016/0125811 | A1 | 5/2016 | Park et al. | |
| 2016/0351095 | A1 | 12/2016 | Tani et al. | |
| 2017/0124947 | A1 | 5/2017 | Kim et al. | |
| 2017/0193912 | A1 | 7/2017 | Choi | |
| 2017/0221936 | A1 | 8/2017 | Yamamoto et al. | |
| 2018/0061320 | A1* | 3/2018 | Kim | G09G 3/3291 |
| 2018/0151119 | A1 | 5/2018 | Lee et al. | |
| 2018/0182303 | A1 | 6/2018 | Jung et al. | |
| 2018/0197462 | A1* | 7/2018 | Nagayama | G09G 3/3233 |
| 2019/0035331 | A1 | 1/2019 | Do et al. | |
| 2019/0164476 | A1 | 5/2019 | Feng et al. | |
| 2019/0164492 | A1 | 5/2019 | Oh | |
| 2020/0105191 | A1* | 4/2020 | Chen | G09G 3/006 |
| 2020/0312246 | A1 | 10/2020 | Xu et al. | |

FOREIGN PATENT DOCUMENTS

| | | | |
|---|---|---|---|
| CN | 105575332 | A | 5/2016 |
| CN | 106205439 | A | 12/2016 |
| CN | 106847171 | A | 6/2017 |
| CN | 107068052 | A | 8/2017 |
| CN | 107767814 | A | 3/2018 |
| CN | 107863067 | A | 3/2018 |
| CN | 108257554 | A | 7/2018 |
| CN | 109119025 | A | 1/2019 |
| CN | 109119026 | A | 1/2019 |
| CN | 109308877 | A | 2/2019 |
| CN | 109493805 | A | 3/2019 |
| CN | 109727578 | A | 5/2019 |
| CN | 109841186 | A | 6/2019 |
| CN | 110264957 | A | 9/2019 |
| KR | 20130037081 | A | 4/2013 |
| KR | 20140082498 | A | 7/2014 |
| KR | 20180059604 | A | 6/2018 |

OTHER PUBLICATIONS

ISA China National Intellectual Property Administration, International Search Report and Written Opinion Issued in Application No. PCT/CN2020/084645, dated Jul. 15, 2020, WIPO, 16 pages. (Submitted with Partial Translation).

* cited by examiner

PIXEL CIRCUIT COMPENSATION METHOD AND DEVICE, AND DISPLAY DEVICE

CROSS-REFERENCE TO RELATED APPLICATION

This application claims priority of Chinese Application No. 201910548785.9, filed on Jun. 24, 2019, the present disclosures of which are incorporated in their entirety by reference herein.

TECHNICAL FIELD

The present disclosure relates to the field of display technologies, and in particular, to a pixel circuit compensation method and device, and a display device.

BACKGROUND AND SUMMARY

An active-matrix organic light emitting diode (AMOLED) display panel has been widely used in many fields due to its advantages such as fast response, high luminous efficiency, high brightness and wide viewing angle. However, display brightness of the AMOLED display panel is uneven.

A first aspect of the present disclosure provides a pixel circuit compensation method for a pixel circuit applied to a display panel, including: when the display panel is in a preset display state, sensing a preset mobility compensation value corresponding to a driving transistor in the pixel circuit; according to the preset mobility compensation value, adjusting an initial mobility compensation value corresponding to the driving transistor to a target mobility compensation value, wherein a difference between the target mobility compensation value and the preset mobility compensation value is less than a threshold; based on the target mobility compensation value, when the display panel is in a non-display state, compensating a mobility of the driving transistor in a preset compensation manner.

Optionally, the method further includes: after compensating the mobility of the driving transistor in the preset compensation manner, when the display panel is in an actual display state, performing real-time compensation for the mobility of the driving transistor in the pixel circuit by compensating a data signal received by the pixel circuit.

Optionally, the pixel circuit includes: an input transistor, a driving transistor, a sensing transistor, a first storage capacitor, a second storage capacitor and an organic light-emitting diode; a gate electrode of the input transistor is coupled to a first control signal line; a first electrode of the input transistor is coupled to a data signal line; a second electrode of the input transistor is coupled to a gate electrode of the driving transistor; a first electrode of the driving transistor is coupled to a power signal line; a second electrode of the driving transistor is coupled to an anode of the organic light-emitting diode; a cathode of the organic light-emitting diode is coupled to a ground signal line; a first terminal of the first storage capacitor is coupled to the gate electrode of the driving transistor; a second terminal of the first storage capacitor is coupled to the second electrode of the driving transistor; a first terminal of the second storage capacitor is coupled to the second electrode of the driving transistor; a second terminal of the second storage capacitor is coupled to the ground signal line; a gate electrode of the sensing transistor is coupled to a second control signal line; a first electrode of the sensing transistor is coupled to the second electrode of the driving transistor; a second electrode of the sensing transistor is coupled to a sensing signal line; the step of based on the target mobility compensation value, when the display panel is in a non-display state, compensating a mobility of the driving transistor in a preset compensation manner, includes: when the display panel is in the non-display state, controlling on-time of the sensing transistor according to the target mobility compensation value, thereby controlling charging time of the second storage capacitor.

Optionally, if the initial mobility compensation value is greater than the target mobility compensation value, when the display panel is in the non-display state, reducing the on time of the sensing transistor and increasing the charging time of the second storage capacitor; or, if the initial mobility compensation value is less than the target mobility compensation value, when the display panel is in the non-display state, increasing the on time of the sensing transistor and reducing the charging time of the second storage capacitor.

Optionally, the method further includes a step of obtaining the initial mobility compensation value before the display panel is in the preset display state; the step includes: enabling the display panel to be in the non-display state, and sensing an initial threshold voltage corresponding to the driving transistor in the pixel circuit; obtaining an initial compensation test signal according to the initial threshold voltage; writing the initial compensation test signal into the gate electrode of the driving transistor, and sensing an initial mobility corresponding to the driving transistor; obtaining the initial mobility compensation value according to a preset standard mobility and the initial mobility.

Optionally, the preset display state is a display state that simulates an actual display state, with working conditions when the display panel is in the preset display state being the same as working conditions when the display panel is in the actual display state; the preset mobility compensation value represents a mobility compensation value that needs to be compensated for the driving transistor in the preset display state.

Optionally, the non-display state includes a shutdown state; the shutdown state means that the display panel does not display images, but the pixel circuit in the display panel is in working state.

Based on the technical solution of the foregoing pixel circuit compensation method, a second aspect of the present disclosure provides a pixel circuit compensation device for a pixel circuit applied to a display panel, including: a sensing circuit configured to, when the display panel is in a preset display state, sense a preset mobility compensation value corresponding to a driving transistor in the pixel circuit; a compensation circuit configured to, according to the preset mobility compensation value, adjust an initial mobility compensation value corresponding to the driving transistor to a target mobility compensation value, wherein a difference between the target mobility compensation value and the preset mobility compensation value is less than a threshold; wherein the compensation circuit is further configured to, based on the target mobility compensation value, when the display panel is in a non-display state, compensate a mobility of the driving transistor in a preset compensation manner.

Optionally, the compensation circuit is further configured to, after compensating the mobility of the driving transistor in the preset compensation manner, when the display panel is in an actual display state, perform real-time compensation for the mobility of the driving transistor in the pixel circuit by compensating a data signal received by the pixel circuit.

Optionally, the pixel circuit includes: an input transistor, a driving transistor, a sensing transistor, a first storage capacitor, a second storage capacitor and an organic light-emitting diode; a gate electrode of the input transistor is coupled to a first control signal line; a first electrode of the input transistor is coupled to a data signal line; a second electrode of the input transistor is coupled to a gate electrode of the driving transistor; a first electrode of the driving transistor is coupled to a power signal line; a second electrode of the driving transistor is coupled to an anode of the organic light-emitting diode; a cathode of the organic light-emitting diode is coupled to a ground signal line; a first terminal of the first storage capacitor is coupled to the gate electrode of the driving transistor; a second terminal of the first storage capacitor is coupled to the second electrode of the driving transistor; a first terminal of the second storage capacitor is coupled to the second electrode of the driving transistor; a second terminal of the second storage capacitor is coupled to the ground signal line; a gate electrode of the sensing transistor is coupled to a second control signal line; a first electrode of the sensing transistor is coupled to the second electrode of the driving transistor; a second electrode of the sensing transistor is coupled to a sensing signal line; wherein the compensation circuit is further configured to, when the display panel is in the non-display state, control on-time of the sensing transistor according to the target mobility compensation value, thereby controlling charging time of the second storage capacitor.

Optionally, the sensing circuit is further configured to, before the display panel is in the preset display state, enable the display panel to be in the non-display state, and sense an initial threshold voltage corresponding to the driving transistor in the pixel circuit; the compensation circuit is further configured to obtain an initial compensation test signal according to the initial threshold voltage, and write the initial compensation test signal into the gate electrode of the driving transistor; the sensing circuit is further configured to sense an initial mobility corresponding to the driving transistor; the compensation circuit is further configured to obtain the initial mobility compensation value according to a preset standard mobility and the initial mobility.

Optionally, the preset display state is a display state that simulates an actual display state, with working conditions when the display panel is in the preset display state being the same as working conditions when the display panel is in the actual display state; the preset mobility compensation value represents a mobility compensation value that needs to be compensated for the driving transistor in the preset display state.

Optionally, the non-display state includes a shutdown state; the shutdown state means that the display panel does not display images, but the pixel circuit in the display panel is in working state.

Based on the technical solution of the foregoing pixel circuit compensation method, a third aspect of the present disclosure provides a display device, including the foregoing pixel circuit compensation device.

A fourth aspect of the present disclosure provides a pixel circuit compensation device for a pixel circuit applied to a display panel, including: a memory and an actuator; wherein the actuator is configured to execute following instructions stored in the memory: when the display panel is in a preset display state, sensing a preset mobility compensation value corresponding to a driving transistor in the pixel circuit; according to the preset mobility compensation value, adjusting an initial mobility compensation value corresponding to the driving transistor to a target mobility compensation value, wherein a difference between the target mobility compensation value and the preset mobility compensation value is less than a threshold; based on the target mobility compensation value, when the display panel is in a non-display state, compensating a mobility of the driving transistor in a preset compensation manner.

Optionally, the actuator is further configured to execute following instructions stored in the memory: after compensating the mobility of the driving transistor in the preset compensation manner, when the display panel is in an actual display state, performing real-time compensation for the mobility of the driving transistor in the pixel circuit by compensating a data signal received by the pixel circuit.

Optionally, the pixel circuit includes: an input transistor, a driving transistor, a sensing transistor, a first storage capacitor, a second storage capacitor and an organic light-emitting diode; a gate electrode of the input transistor is coupled to a first control signal line; a first electrode of the input transistor is coupled to a data signal line; a second electrode of the input transistor is coupled to a gate electrode of the driving transistor; a first electrode of the driving transistor is coupled to a power signal line; a second electrode of the driving transistor is coupled to an anode of the organic light-emitting diode; a cathode of the organic light-emitting diode is coupled to a ground signal line; a first terminal of the first storage capacitor is coupled to the gate electrode of the driving transistor; a second terminal of the first storage capacitor is coupled to the second electrode of the driving transistor; a first terminal of the second storage capacitor is coupled to the second electrode of the driving transistor; a second terminal of the second storage capacitor is coupled to the ground signal line; a gate electrode of the sensing transistor is coupled to a second control signal line; a first electrode of the sensing transistor is coupled to the second electrode of the driving transistor; a second electrode of the sensing transistor is coupled to a sensing signal line; wherein the actuator is further configured to execute following instructions stored in the memory: when the display panel is in the non-display state, controlling on-time of the sensing transistor according to the target mobility compensation value, thereby controlling charging time of the second storage capacitor.

Optionally, the actuator is further configured to execute following instructions stored in the memory: before the display panel is in the preset display state, enabling the display panel to be in the non-display state, and sensing an initial threshold voltage corresponding to the driving transistor in the pixel circuit; obtaining an initial compensation test signal according to the initial threshold voltage; writing the initial compensation test signal into the gate electrode of the driving transistor, and sensing an initial mobility corresponding to the driving transistor; obtaining the initial mobility compensation value according to a preset standard mobility and the initial mobility.

BRIEF DESCRIPTION OF THE DRAWINGS

The drawings described herein are used to provide further understanding of the present disclosure and constitute a part of the present disclosure. Exemplary embodiments of the present disclosure and their descriptions are used to explain the present disclosure, and do not constitute an improper limitation to the present disclosure. In the drawings.

Figure 1:
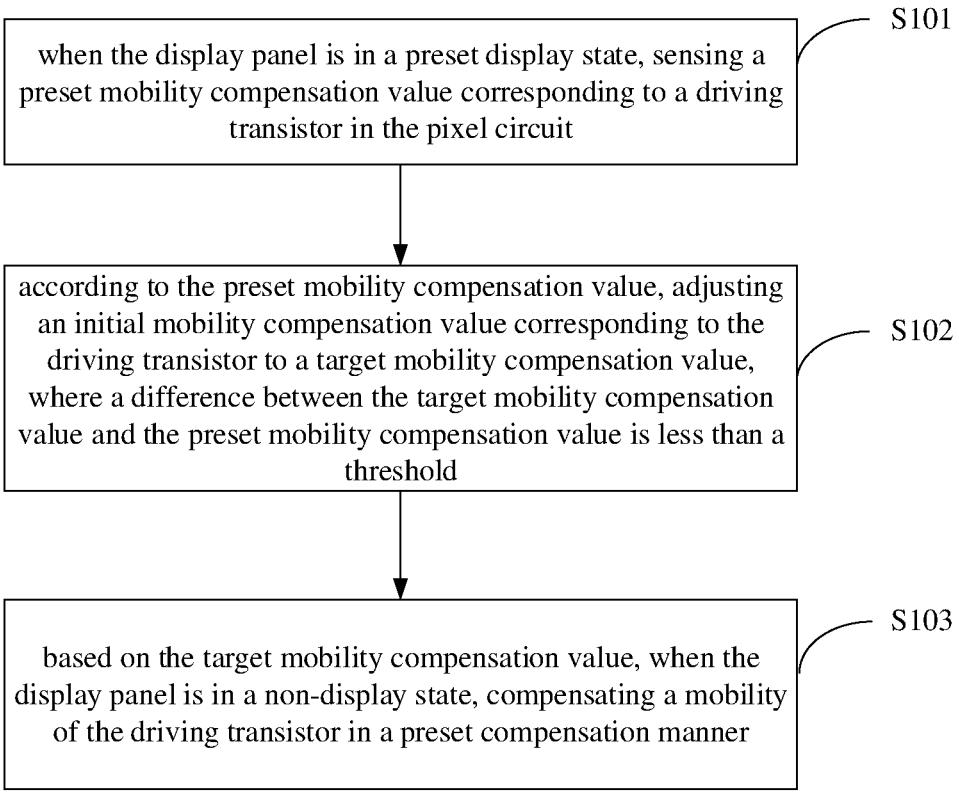
FIG. 1 is a schematic flow chart of a pixel circuit compensation method according to an embodiment of the present disclosure.

| Reference numbers: | |
|---|---|
| T1-input transistor, | DTFT-driving transistor, |
| T2-sensing transistor, | C1-first storage capacitor, |
| C2-second storage capacitor, | DL-data signal line, |
| Scan-first control signal line, | ELVDD-power signal line, |
| OLED-lighting unit, | VSS-ground signal line, |
| Sense-second control signal line, | SL-sensing signal line. |

DETAILED DESCRIPTION

In order to further explain a pixel circuit compensation method and device, and a display device provided in the embodiments of the present disclosure, a detailed description will be given below with reference to the accompanying drawings.

An AMOLED display panel includes pixel circuits and light-emitting units that are corresponding to the pixel circuits in a one-to-one manner. Each pixel circuit includes a driving transistor, a storage capacitor and some transistors having a switching function. During operation, various components included in the pixel circuit cooperate with each other to generate a driving signal, and this driving signal drives the light-emitting unit to emit light.

The driving signal is related to a threshold voltage and an electron mobility of the driving transistor. However, when manufacturing the AMOLED display panel, due to limitation of manufacturing process conditions, characteristic parameters (such as the threshold voltage and the electron mobility) of the driving transistors in various pixel circuits included in the display panel are different. Thus, when driving the display panel to display, even if a same data signal is input to various pixel circuits, driving currents generated by the driving transistors are also different, which in turn results in different light-emitting brightness of the light-emitting units driven by the driving transistors and then causes poor brightness uniformity of the display panel.

In view of the above problems, since the driving current generated by the driving transistor is mainly related to the threshold voltage and the electron mobility of the driving transistor, most of solutions in the related art are to perform shutdown compensation operations for the threshold voltage and the electron mobility of the driving transistors included in all pixel circuits. That is, when a display panel is turned off, a threshold voltage of a driving transistor is detected, then an electron mobility of the driving transistor is calculated according to the threshold voltage, and then the electron mobility of the driving transistor is further compensated (generally, an electron mobility compensation is performed after a threshold voltage compensation), so that the driving transistors in various pixel circuits in the display panel generate the same driving current when a same data signal is input, thereby reducing brightness deviation between different light-emitting units. However, the current electron mobility compensation is usually to detect the threshold voltage of the driving transistor and perform compensation according to the threshold voltage in a shutdown state, after the driving transistor is driven for a long time when the display panel is in actual display operation, both the threshold voltage and the electron mobility of the driving transistor will change due to environmental factors such as temperature, which results in that the compensation for the threshold voltage and the electron mobility of the driving transistor in the shutdown state is not accurate and there is still a brightness deviation between the light-emitting units.

Based on the existence of the foregoing problem, the inventors of the present disclosure have found that real-time luminance compensation for a display panel can be realized by compensating data signals input to various pixels when the display panel is actually displayed. However, when the display panel is actually displayed, the characteristic parameters of the driving transistor in the pixel circuit shift greatly, resulting in a large difference between an actual required mobility compensation value and a mobility compensation value during the shutdown compensation operation. Thus, when performing real-time brightness compensation, the brightness of the display panel changes greatly during the process of real-time brightness compensation, resulting in a phenomenon that the display brightness of the display panel is unstable (increased brightness or decreased brightness). Based on the existence of this problem, the present disclosure proposes a solution to this problem, specifically as follows.

As shown in FIG. 1, one embodiment of the present disclosure provides a pixel circuit compensation method for a pixel circuit applied to a display panel. The compensation method includes:

Step S101: when the display panel is in a preset display state, sensing a preset mobility compensation value corresponding to a driving transistor in the pixel circuit;

Step S102: according to the preset mobility compensation value, adjusting an initial mobility compensation value corresponding to the driving transistor to a target mobility compensation value, where a difference between the target mobility compensation value and the preset mobility compensation value is less than a threshold;

Step S103: based on the target mobility compensation value, when the display panel is in a non-display state, compensating a mobility of the driving transistor in a preset compensation manner.

Specifically, the preset display state may be specifically a display state that simulates an actual display state, that is, working conditions (such as working environment and working time) when the display panel is in the preset display state, are the same as working conditions when the display panel is in the actual display state. When the display panel is in the preset display state, the preset mobility compensation value corresponding to the driving transistor in the pixel circuit included in the display panel is sensed, and the preset mobility compensation value represents a mobility compensation value that needs to be compensated for the driving transistor in a current preset display state.

After obtaining the preset mobility compensation value, the initial mobility compensation value corresponding to the driving transistor may be adjusted, so that the initial mobility compensation value is adjusted to the target mobility compensation value. The difference between the target mobility compensation value and the preset mobility compensation value is less than the threshold. The threshold may be set according to actual needs, for example, the threshold may be zero.

After obtaining the target mobility compensation value, when the display panel is in the non-display state, the mobility of the driving transistor is compensated in a preset compensation manner based on the target mobility compensation value, so that when the display panel is just in the actual display state, the mobility of the driving transistor is closer to a preset standard mobility.

It should be noted that the foregoing non-display state may include a shutdown state. The shutdown state herein means that the display panel does not display images, but the pixel circuit in the display panel may be in working state, that is, the pixel circuit can generate a driving signal but the driving signal cannot drive light-emitting elements to emit light.

In the pixel circuit compensation method provided in the embodiment of the present disclosure, it is to first enable the display panel in the preset display state with the same working conditions as the actual display state, so that the characteristic parameters of the driving transistor in the pixel circuit are the same as or close to the characteristic parameters of the driving transistor in the pixel circuit in the actual display state; then, sense the preset mobility compensation value corresponding to the driving transistor in the pixel circuit in the preset display state; subsequently, according to the preset mobility compensation value, adjust the initial mobility compensation value corresponding to the driving transistor to the target mobility compensation value, where the difference between the target mobility compensation value and the preset mobility compensation value is less than the threshold; and then, based on the target mobility compensation value, when the display panel is in the non-display state, compensate the mobility of the driving transistor in the preset compensation manner. Therefore, when the pixel circuit compensation method provided in the embodiment of the present disclosure is used for performing preset compensation, after the mobility of the driving transistor is compensated in the preset compensation manner, the mobility corresponding to the driving transistor is close to or the same as the preset standard mobility required during actual display, so that when the display panel is in the actual display state, the mobility corresponding to the driving transistor at an initial stage of lighting up the display panel is close to or the same as the preset standard mobility required during actual display, thereby avoiding the problem of unstable display brightness of the display panel (increased brightness or decreased brightness) caused by great changes in the brightness of the display panel when real-time brightness compensation is performed on the display panel.

In some embodiments, the compensation method provided in the foregoing embodiment further includes: after compensating the mobility of the driving transistor in the preset compensation manner, when the display panel is in an actual display state, performing real-time compensation for the mobility of the driving transistor in the pixel circuit by compensating a data signal received by the pixel circuit.

Specifically, when the display panel is in the actual display state, the temperature of the display panel changes as the display time extends. Due to the influence of the temperature of the display panel, the characteristic parameters of the driving transistor will continue to shift, which affects the display brightness uniformity of the display panel. In order to avoid this problem, after the mobility of the driving transistor is compensated in the preset compensation manner, when the display panel is in the actual display state, the real-time compensation can be continued to be performed for the driving transistor. In this way, even the characteristic parameters of the driving transistor shift greatly in the actual display state, the characteristic parameters of the driving transistor can be compensated, thereby ensuring the display brightness uniformity of the display panel.

When the display panel is actually displaying, a data signal is written into a gate electrode of the driving transistor. Under the action of the data signal, the driving transistor generates a corresponding driving current, thereby driving the corresponding light-emitting unit to emit light. Therefore, when the display panel is in the actual display state, the data signal received by the gate electrode of the driving transistor in the pixel circuit is compensated, and then the compensated data signal is written into the gate electrode of the driving transistor, thereby realizing the real-time compensation for the mobility of the driving transistor in the pixel circuit and ensuring the display brightness uniformity of the display panel.

Figure 2:
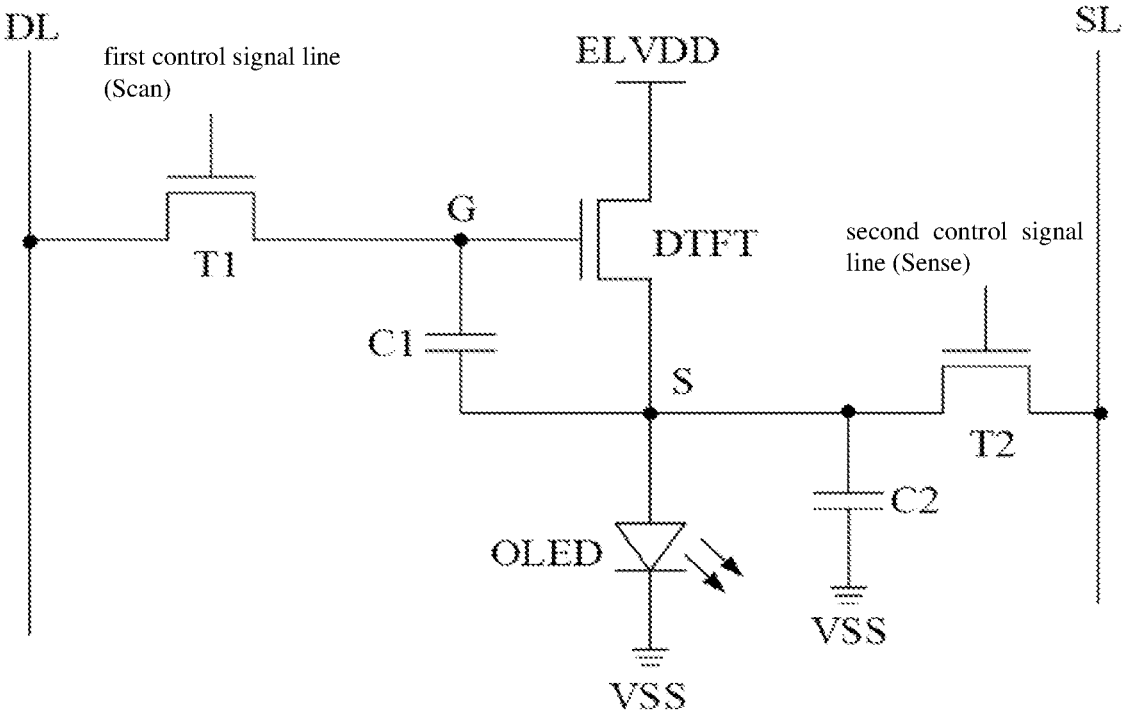
FIG. 2 is a schematic structural diagram of a pixel circuit according to an embodiment of the present disclosure.

As shown in FIG. 2, in some embodiments, the pixel circuit provided in the foregoing embodiment may include: an input transistor T1, a driving transistor DTFT, a sensing transistor T2, a first storage capacitor C1, a second storage capacitor C2, and an organic light-emitting diode OLED. A gate electrode of the input transistor T1 is coupled to a first control signal line Scan. A first electrode of the input transistor T1 is coupled to a data signal line DL. A second electrode of the input transistor T1 is coupled to a gate electrode of the driving transistor DTFT. A first electrode of the driving transistor DTFT is coupled to a power signal line ELVDD. A second electrode of the driving transistor DTFT is coupled to an anode of the organic light-emitting diode OLED. A cathode of the organic light-emitting diode OLED is coupled to a ground signal line VSS. A first terminal of the first storage capacitor C1 is coupled to the gate electrode of the driving transistor DTFT. A second terminal of the first storage capacitor C1 is coupled to the second electrode of the driving transistor DTFT. A first terminal of the second storage capacitor C2 is coupled to the second electrode of the driving transistor DTFT. A second terminal of the second storage capacitor C2 is coupled to the ground signal line VSS. A gate electrode of the sensing transistor T2 is coupled to a second control signal line Sense. A first electrode of the sensing transistor T2 is coupled to the second electrode of the driving transistor DTFT. A second electrode of the sensing transistor T2 is coupled to a sensing signal line SL.

Based on the specific structure of the foregoing pixel circuit, the step of based on the target mobility compensation value, when the display panel is in a non-display state, compensating a mobility of the driving transistor in a preset compensation manner, includes: when the display panel is in the non-display state, controlling on-time of the sensing transistor T2 according to the target mobility compensation value, thereby controlling charging time of the second storage capacitor C2.

Specifically, when the sensing transistor T2 is in an off state, the sensing transistor T2 disconnects coupling between the first terminal of the second storage capacitor C2 and the sensing signal line SL. In this state, the driving transistor DTFT can charge the second storage capacitor C2. When the sensing transistor T2 is in an on state, the sensing transistor T2 turns on the coupling between the first terminal of the second storage capacitor C2 and the sensing signal line SL. In this state, the driving transistor DTFT can stop charging the second storage capacitor C2.

When the mobility of the driving transistor DTFT is compensated when the display panel is in the non-display state, as the charging time for the second storage capacitor C2 increases, charges on the second storage capacitor C2 will increase, so that a charging voltage of the second storage capacitor C2 increases. The mobility compensation value has a negative correlation with the charging voltage, that is, the greater the charging voltage, the smaller the mobility compensation value, and the smaller the charging voltage, the greater the mobility compensation value. Therefore, by controlling the charging time of the second storage capacitor C2, the electron mobility of the driving transistor DTFT can be controlled, thereby realizing compensation for the mobility of the driving transistor DTFT based on the target mobility compensation value.

In some embodiments, the step of controlling on-time of the sensing transistor T2 according to the target mobility compensation value, thereby controlling charging time of the second storage capacitor C2, specifically includes:

if the initial mobility compensation value is greater than the target mobility compensation value, when the display panel is in the non-display state, reducing the on time of the sensing transistor T2 and increasing the charging time of the second storage capacitor C2; or, if the initial mobility compensation value is less than the target mobility compensation value, when the display panel is in the non-display state, increasing the on time of the sensing transistor and reducing the charging time of the second storage capacitor C2.

Specifically, if the initial mobility compensation value is greater than the target mobility compensation value, when the display panel is in the non-display state, the on-time of the sensing transistor T2 may be reduced and the charging time of the second storage capacitor C2 may be increased so as to increase the charging voltage of the second storage capacitor C2, so that the initial mobility compensation value corresponding to the driving transistor DTFT is reduced to the target mobility compensation value, thereby realizing compensation for the driving transistor DTFT.

If the initial mobility compensation value is less than the target mobility compensation value, when the display panel is in the non-display state, the on time of the sensing transistor T2 may be increased and the charging time of the second storage capacitor C2 may be reduced so as to reduce the charging voltage of the second storage capacitor C2, so that the initial mobility compensation value corresponding to the driving transistor DTFT is increased to the target mobility compensation value, thereby realizing compensation for the driving transistor DTFT.

In some embodiments, the compensation method provided in the foregoing embodiment further includes: a step of obtaining the initial mobility compensation value before the display panel is in the preset display state. This step specifically includes:

enabling the display panel to be in a non-display state, and sensing an initial threshold voltage corresponding to the driving transistor DTFT in the pixel circuit;

obtaining an initial compensation test signal according to the initial threshold voltage;

writing the initial compensation test signal into the gate electrode of the driving transistor DTFT, and sensing an initial mobility corresponding to the driving transistor DTFT;

obtaining the initial mobility compensation value according to a preset standard mobility and the initial mobility.

Specifically, when the pixel circuit adopts the foregoing specific structure, the step of enabling the display panel to be in a non-display state, and sensing an initial threshold voltage corresponding to the driving transistor DTFT in the pixel circuit, specifically includes: controlling turning on the input transistor T1 by a first control signal input by the first control signal line Scan; controlling turning off the input transistor T2 by a second control signal input by the second control signal line Sense; writing a test data signal into the data signal line DL, so that the test data signal is transmitted to the gate electrode G of the driving transistor DTFT through the input transistor T1 and changes the voltage of the gate electrode G of the driving transistor DTFT to Vg, and an output electrode (i.e., a source electrode S) of the driving transistor DTFT has an initialization voltage $V_0$; when a voltage difference Vgs between the gate electrode and the source electrode of the driving transistor DTFT is greater than the threshold voltage of the driving transistor DTFT, turning on the driving transistor DTFT to generate a driving current $I_{oled}$, where the driving current charges the second storage capacitor C2 so that a potential of the source electrode of the driving transistor DTFT increases continuously as the charging time increases; until the driving transistor DTFT is in the off state and the potential of the source electrode of the driving transistor DTFT no longer rises, stopping charging the second storage capacitor C2; controlling turning on the sensing transistor T2 by a second control signal input by the second control signal line Sense, and sensing the voltage Vs (i.e., a sensed voltage) of the source electrode of the driving transistor DTFT by the sensing signal line SL, thereby obtaining the initial threshold voltage of the driving transistor DTFT as Vth=Vg−Vs.

The step of obtaining an initial compensation test signal according to the initial threshold voltage, specifically includes: determining the compensation test signal Vdata1 as:

Vdata1=GL+Vth; where GL is a fixed value, and Vth represents an initial threshold voltage of the driving transistor.

The initial threshold voltage Vth, the initial mobility K, and the driving current $I_{oled}$ of the foregoing driving transistor DTFT satisfy the following formula:

$$I_{oled} = \frac{1}{2}K \times \mathrm{Cos} \times \frac{W}{L} \times (V_{gs} - V_{th})^2 \qquad \text{formula (1)}$$

where, Cox represents a gate oxide capacitance, W/L represents a width to length ratio of a channel region of the driving transistor DTFT, and Vgs represents a gate-source voltage of the driving transistor DTFT.

When the compensation test signal Vdata1 is written to the gate electrode of the driving transistor DTFT, the generated driving current $I_{oled}$ is:

$$I_{oled} = \frac{1}{2}K \times Cox \times \frac{W}{L} \times (V_{data1} - V_{th})^2 \qquad \text{formula (2)}$$

After substituting Vdata1=GL+Vth into the formula (2), the following formula is obtained:

$$I_{oled} = \frac{1}{2}K \times Cox \times \frac{W}{L} \times (GL + V_{th} - V_{th})^2 = \frac{1}{2}K \times Cox \times \frac{W}{L} \times (GL)^2$$

The second storage capacitor is charged by the driving current $I_{oled}$. After the charging time T, the voltage Vs of the source electrode of the driving transistor DTFT (i.e., the charging voltage of the second storage capacitor) is sensed through the sensing signal line SL. According to the charging time T and the current voltage Vs of the source electrode, $I_{oled}$ is obtained as:

$$I_{oled} = \frac{V_s \times C'}{T} \qquad \text{formula (3)}$$

where C' represents a capacitance value of the second storage capacitor C2, and the second storage capacitor C2 may be a parasitic capacitance.

Then, the initial compensation value K' of the mobility can be obtained according to the preset standard mobility K0 as:

$$K' = \frac{K_0}{K} \quad \text{formula (4)}$$

One embodiment of the present disclosure further provides a pixel circuit compensation device, which is used to implement the compensation method provided in the foregoing embodiment. The compensation device includes:

a sensing circuit configured to, when a display panel is in a preset display state, sense a preset mobility compensation value corresponding to a driving transistor in the pixel circuit;

a compensation circuit configured to, according to the preset mobility compensation value, adjust an initial mobility compensation value corresponding to the driving transistor to a target mobility compensation value, where a difference between the target mobility compensation value and the preset mobility compensation value is less than a threshold.

The compensation circuit is further configured to, based on the target mobility compensation value, when the display panel is in a non-display state, compensate a mobility of the driving transistor in a preset compensation manner.

Specifically, the preset display state may be specifically a display state that simulates an actual display state, that is, working conditions when the display panel is in the preset display state, are the same as working conditions when the display panel is in the actual display state. When the display panel is in the preset display state, the preset mobility compensation value corresponding to the driving transistor in the pixel circuit included in the display panel is sensed, and the preset mobility compensation value represents a mobility compensation value that needs to be compensated for the driving transistor in a current preset display state.

After obtaining the preset mobility compensation value, the compensation circuit may adjust the initial mobility compensation value corresponding to the driving transistor, so that the initial mobility compensation value is adjusted to the target mobility compensation value. The difference between the target mobility compensation value and the preset mobility compensation value is less than the threshold. The threshold may be set according to actual needs, for example, the threshold may be zero.

After obtaining the target mobility compensation value, when the display panel is in the non-display state, the compensation circuit may compensate the mobility of the driving transistor in a preset compensation manner based on the target mobility compensation value, so that when the display panel is just in the actual display state, the mobility of the pre-compensated driving transistor is closer to a preset standard mobility.

In the pixel circuit compensation device provided in the embodiment of the present disclosure, it first enables the display panel in the preset display state with the same working conditions as the actual display state, so that the characteristic parameters of the driving transistor in the pixel circuit are the same as or close to the characteristic parameters of the driving transistor in the pixel circuit in the actual display state; then, senses the preset mobility compensation value corresponding to the driving transistor in the pixel circuit in the preset display state; subsequently, according to the preset mobility compensation value, adjusts the initial mobility compensation value corresponding to the driving transistor to the target mobility compensation value, where the difference between the target mobility compensation value and the preset mobility compensation value is less than the threshold; and then, based on the target mobility compensation value, when the display panel is in the non-display state, compensates the mobility of the driving transistor in the preset compensation manner. Therefore, when the pixel circuit compensation device provided in the embodiment of the present disclosure is used for performing preset compensation, after the mobility of the driving transistor is compensated in the preset compensation manner, the mobility corresponding to the driving transistor is close to or the same as the preset standard mobility required during actual display, so that when the display panel is in the actual display state, the mobility corresponding to the driving transistor at an initial stage of lighting up the display panel is close to or the same as the preset standard mobility required during actual display, thereby avoiding the problem of unstable display brightness of the display panel (increased brightness or decreased brightness) caused by great changes in the brightness of the display panel when real-time brightness compensation is performed on the display panel.

In some embodiments, the compensation circuit provided in the foregoing embodiment is further configured to, after compensating the mobility of the driving transistor in the preset compensation manner, when the display panel is in an actual display state, perform real-time compensation for the mobility of the driving transistor in the pixel circuit by compensating a data signal received by the pixel circuit.

Specifically, when the display panel is in the actual display state, the temperature of the display panel changes as the display time extends. Due to the influence of the temperature of the display panel, the characteristic parameters of the driving transistor will continue to shift, which affects the display brightness uniformity of the display panel. In order to avoid this problem, after the mobility of the driving transistor is compensated in the preset compensation manner, when the display panel is in the actual display state, the compensation circuit continues to perform the real-time compensation for the driving transistor. In this way, even the characteristic parameters of the driving transistor shift greatly in the actual display state, the characteristic parameters of the driving transistor can be compensated, thereby ensuring the display brightness uniformity of the display panel.

When the display panel is actually displaying, a data signal is written into a gate electrode of the driving transistor. Under the action of the data signal, the driving transistor generates a corresponding driving current, thereby driving the corresponding light-emitting unit to emit light. Therefore, when the display panel is in the actual display state, the data signal received by the gate electrode of the driving transistor in the pixel circuit is compensated, and then the compensated data signal is written into the gate electrode of the driving transistor, thereby realizing the real-time compensation for the mobility of the driving transistor in the pixel circuit and ensuring the display brightness uniformity of the display panel.

As shown in FIG. 2, in some embodiments, the pixel circuit provided in the foregoing embodiment may include: an input transistor T1, a driving transistor DTFT, a sensing transistor T2, a first storage capacitor C1, a second storage capacitor C2, and an organic light-emitting diode OLED. A gate electrode of the input transistor T1 is coupled to a first control signal line Scan. A first electrode of the input transistor T1 is coupled to a data signal line DL. A second electrode of the input transistor T1 is coupled to a gate electrode of the driving transistor DTFT. A first electrode of the driving transistor DTFT is coupled to a power signal line ELVDD. A second electrode of the driving transistor DTFT is coupled to an anode of the organic light-emitting diode OLED. A cathode of the organic light-emitting diode OLED is coupled to a ground signal line VSS. A first terminal of the first storage capacitor C1 is coupled to the gate electrode of the driving transistor DTFT. A second terminal of the first storage capacitor C1 is coupled to the second electrode of the driving transistor DTFT. A first terminal of the second storage capacitor C2 is coupled to the second electrode of the driving transistor DTFT. A second terminal of the second storage capacitor C2 is coupled to the ground signal line VSS. A gate electrode of the sensing transistor T2 is coupled to a second control signal line Sense. A first electrode of the sensing transistor T2 is coupled to the second electrode of the driving transistor DTFT. A second electrode of the sensing transistor T2 is coupled to a sensing signal line SL.

The compensation circuit is further configured to, when the display panel is in the non-display state, control on-time of the sensing transistor according to the target mobility compensation value, thereby controlling charging time of the second storage capacitor C2.

Specifically, when the sensing transistor T2 is in an off state, the sensing transistor T2 disconnects coupling between the first terminal of the second storage capacitor C2 and the sensing signal line SL. In this state, the driving transistor DTFT can charge the second storage capacitor C2. When the sensing transistor T2 is in an on state, the sensing transistor T2 turns on the coupling between the first terminal of the second storage capacitor C2 and the sensing signal line. In this state, the driving transistor DTFT can stop charging the second storage capacitor C2.

When the mobility of the driving transistor DTFT is compensated when the display panel is in the non-display state, as the charging time for the second storage capacitor C2 increases, charges on the second storage capacitor C2 will increase, so that a charging voltage of the second storage capacitor C2 increases. The mobility compensation value has a negative correlation with the charging voltage, that is, the greater the charging voltage, the smaller the mobility compensation value, and the smaller the charging voltage, the greater the mobility compensation value. Therefore, by controlling the charging time of the second storage capacitor C2, the electron mobility of the driving transistor DTFT can be controlled, thereby realizing compensation for the mobility of the driving transistor DTFT based on the target mobility compensation value.

In some embodiments, if the initial mobility compensation value is greater than the target mobility compensation value, when the display panel is in the non-display state, the compensation circuit is configured to reduce the on time of the sensing transistor T2 and increase the charging time of the second storage capacitor C2; or, if the initial mobility compensation value is less than the target mobility compensation value, when the display panel is in the non-display state, the compensation circuit is configured to increase the on time of the sensing transistor and reduce the charging time of the second storage capacitor C2.

In some embodiments, the sensing circuit provided in the foregoing embodiment is further configured to, before the display panel is in the preset display state, enable the display panel to be in a non-display state, and sense an initial threshold voltage corresponding to the driving transistor DTFT in the pixel circuit.

The compensation circuit is further configured to obtain an initial compensation test signal according to the initial threshold voltage, and write the initial compensation test signal into the gate electrode of the driving transistor.

The sensing circuit is further configured to sense an initial mobility corresponding to the driving transistor.

The compensation circuit is further configured to obtain the initial mobility compensation value according to a preset standard mobility and the initial mobility.

Specifically, when the pixel circuit adopts the foregoing specific structure, the step that the sensing circuit enables the display panel to be in the non-display state, and senses the initial threshold voltage corresponding to the driving transistor DTFT in the pixel circuit, specifically includes: controlling turning on the input transistor T1 by a first control signal input by the first control signal line Scan; controlling turning off the input transistor T2 by a second control signal input by the second control signal line Sense; writing a test data signal into the data signal line DL, so that the test data signal is transmitted to the gate electrode G of the driving transistor DTFT through the input transistor T1 and changes the voltage of the gate electrode G of the driving transistor DTFT to Vg, and an output electrode (i.e., a source electrode S) of the driving transistor DTFT has an initialization voltage $V_0$; when a voltage difference Vgs between the gate electrode and the source electrode of the driving transistor DTFT is greater than the threshold voltage of the driving transistor DTFT, turning on the driving transistor DTFT to generate a driving current $I_{oled}$, where the driving current charges the second storage capacitor C2 so that a potential of the source electrode of the driving transistor DTFT increases continuously as the charging time increases; until the driving transistor DTFT is in the off state and the potential of the source electrode of the driving transistor DTFT no longer rises, stopping charging the second storage capacitor C2; controlling turning on the sensing transistor T2 by a second control signal input by the second control signal line Sense, and sensing the voltage Vs (i.e., a sensed voltage) of the source electrode of the driving transistor DTFT by the sensing signal line SL, thereby obtaining the initial threshold voltage of the driving transistor DTFT as Vth=Vg−Vs.

The step that the compensation circuit obtains the initial compensation test signal according to the initial threshold voltage, specifically includes: determining the compensation test signal Vdata1 as:

Vdata1=GL+Vth; where GL is a fixed value, and Vth represents an initial threshold voltage of the driving transistor.

The initial threshold voltage Vth, the initial mobility K, and the driving current led of the foregoing driving transistor DTFT satisfy the following formula:

$$I_{oled} = \frac{1}{2} K \times Cox \times \frac{W}{L} \times (V_{gs} - V_{th})^2$$

where, Cox represents a gate oxide capacitance, W/L represents a width to length ratio of a channel region of the driving transistor DTFT, and Vgs represents a gate-source voltage of the driving transistor DTFT.

When the compensation circuit writes the compensation test signal Vdata1 to the gate electrode of the driving transistor DTFT, the generated driving current $I_{oled}$ is:

$$I_{oled} = \frac{1}{2}K \times Cox \times \frac{W}{L} \times (V_{data1} - V_{th})^2$$

After substituting Vdata1=GL+Vth into the foregoing formula, the following formula is obtained:

$$I_{oled} = \frac{1}{2}K \times Cox \times \frac{W}{L} \times (GL + V_{th} - V_{th})^2 = \frac{1}{2}K \times Cox \times \frac{W}{L} \times (GL)^2$$

The second storage capacitor is charged by the driving current $I_{oled}$. After the charging time T, the sensing circuit senses the voltage Vs of the source electrode of the driving transistor DTFT (i.e., the charging voltage of the second storage capacitor) through the sensing signal line SL. According to the charging time T and the current voltage Vs of the source electrode, $I_{oled}$ is obtained as:

$$I_{oled} = \frac{V_s \times C'}{T}$$

where C' represents a capacitance value of the second storage capacitor C2, and the second storage capacitor C2 may be a parasitic capacitance.

Then, the compensation circuit can obtain the initial compensation value K' of the mobility according to the preset standard mobility K0 as:

$$K' = \frac{K_0}{K}$$

One embodiment of the present disclosure provides a display device, including the pixel circuit compensation device provided in the foregoing embodiment.

When the pixel circuit compensation method provided in the foregoing embodiment is used for preset compensation, it can avoid the problem of unstable display brightness of the display panel (increased brightness or decreased brightness) caused by great changes in the brightness of the display panel when real-time brightness compensation is performed on the display panel; thus, when the display device provided in the embodiments of the present disclosure includes the pixel circuit compensation device provided in the foregoing embodiment, the above beneficial effects can also be achieved, which will not be repeated here.

One embodiment of the present disclosure further provides a pixel circuit compensation device. The pixel circuit is applied to a display panel. The compensation device includes: a memory and an actuator. The actuator is configured to execute following instructions stored in the memory: when the display panel is in a preset display state, sensing a preset mobility compensation value corresponding to a driving transistor in the pixel circuit; according to the preset mobility compensation value, adjusting an initial mobility compensation value corresponding to the driving transistor to a target mobility compensation value, where a difference between the target mobility compensation value and the preset mobility compensation value is less than a threshold; based on the target mobility compensation value, when the display panel is in a non-display state, compensating a mobility of the driving transistor in a preset compensation manner. The pixel circuit compensation device of the embodiment of the present disclosure can be used to implement the compensation method provided in the foregoing embodiment. For the convenience and conciseness of description, the specific working process of the pixel circuit compensation device of the embodiment of the present disclosure may refer to the corresponding process of the method embodiment, which will not be elaborated herein.

It should be noted that the display device may be any product or component with a display function, such as a TV, a monitor, a digital photo frame, a mobile phone, a tablet computer.

Unless otherwise defined, any technical or scientific terms used herein shall have the common meaning understood by a person of ordinary skills. Such words as "first" and "second" used in the specification and claims are merely used to differentiate different components rather than to represent any order, number or importance. Such words as "comprises" or "include" mean that an element or object appearing before the word covers elements or objects listed after the word and their equivalents, but do not exclude other elements or objects. Similarly, such words as "connect" or "connected to" may include electrical connection, direct or indirect, rather than being limited to physical or mechanical connection. Such words as "on/above", "under/below", "left" and "right" are merely used to represent relative position relationship, and when an absolute position of an object is changed, the relative position relationship will be changed too.

It will be understood that when an element such as a layer, film, region, or substrate is referred to as being "on" or "under" another element, this element may be "directly" on or "under" the other element, or, there may be an intermediate element therebetween.

In the description of the above embodiments, specific features, structures, materials or characteristics may be combined in any suitable manner in any one or more embodiments or examples.

The above are merely the embodiments of the present disclosure and shall not be used to limit the scope of the present disclosure. It should be noted that, a person skilled in the art may make improvements and modifications without departing from the principle of the present disclosure, and these improvements and modifications shall also fall within the scope of the present disclosure. The protection scope of the present disclosure shall be subject to the protection scope of the claims.

The invention claimed is:

1. A pixel circuit compensation method for a pixel circuit applied to a display panel, comprising:

when the display panel is in a preset display state, sensing a preset mobility compensation value corresponding to a driving transistor in the pixel circuit;

according to the preset mobility compensation value, adjusting an initial mobility compensation value corresponding to the driving transistor to a target mobility compensation value, wherein a difference between the target mobility compensation value and the preset mobility compensation value is less than a threshold, and wherein the threshold is zero;

based on the target mobility compensation value, when the display panel is in a non-display state, compensating a mobility of the driving transistor in a preset compensation manner;

wherein the pixel circuit includes: an input transistor, a driving transistor, a sensing transistor, a first storage capacitor, a second storage capacitor and an organic light-emitting diode; a gate electrode of the input transistor is coupled to a first control signal line; a first electrode of the input transistor is coupled to a data signal line; a second electrode of the input transistor is coupled to a gate electrode of the driving transistor; a first electrode of the driving transistor is coupled to a power signal line; a second electrode of the driving transistor is coupled to an anode of the organic light-emitting diode; a cathode of the organic light-emitting diode is coupled to a ground signal line; a first terminal of the first storage capacitor is coupled to the gate electrode of the driving transistor; a second terminal of the first storage capacitor is coupled to the second electrode of the driving transistor; a first terminal of the second storage capacitor is coupled to the second electrode of the driving transistor; a second terminal of the second storage capacitor is coupled to the ground signal line; a gate electrode of the sensing transistor is coupled to a second control signal line; a first electrode of the sensing transistor is coupled to the second electrode of the driving transistor; a second electrode of the sensing transistor is coupled to a sensing signal line; and the step of, based on the target mobility compensation value, when the display panel is in a non-display state, compensating a mobility of the driving transistor in a preset compensation manner, includes:

when the display panel is in the non-display state, controlling on-time of the sensing transistor according to the target mobility compensation value, thereby controlling charging time of the second storage capacitor.

2. The method according to claim 1, wherein the method further includes: after compensating the mobility of the driving transistor in the preset compensation manner, when the display panel is in an actual display state, performing real-time compensation for the mobility of the driving transistor in the pixel circuit by compensating a data signal received by the pixel circuit.

3. The method according to claim 1, wherein if the initial mobility compensation value is greater than the target mobility compensation value, when the display panel is in the non-display state, reducing the on time of the sensing transistor and increasing the charging time of the second storage capacitor; or, if the initial mobility compensation value is less than the target mobility compensation value, when the display panel is in the non-display state, increasing the on time of the sensing transistor and reducing the charging time of the second storage capacitor.

4. The method according to claim 1, wherein the method further includes a step of obtaining the initial mobility compensation value before the display panel is in the preset display state; the step includes:

enabling the display panel to be in the non-display state, and sensing an initial threshold voltage corresponding to the driving transistor in the pixel circuit;

obtaining an initial compensation test signal according to the initial threshold voltage;

writing the initial compensation test signal into the gate electrode of the driving transistor, and sensing an initial mobility corresponding to the driving transistor;

obtaining the initial mobility compensation value according to a preset standard mobility and the initial mobility.

5. The method according to claim 1, wherein the preset display state is a display state that simulates an actual display state, with working conditions when the display panel is in the preset display state being the same as working conditions when the display panel is in the actual display state;

the preset mobility compensation value represents a mobility compensation value that needs to be compensated for the driving transistor in the preset display state.

6. The method according to claim 1, wherein the non-display state includes a shutdown state; the shutdown state means that the display panel does not display images, but the pixel circuit in the display panel is in working state.

7. A pixel circuit compensation device for a pixel circuit applied to a display panel, comprising:

a sensing circuit configured to, when the display panel is in a preset display state, sense a preset mobility compensation value corresponding to a driving transistor in the pixel circuit;

a compensation circuit configured to, according to the preset mobility compensation value, adjust an initial mobility compensation value corresponding to the driving transistor to a target mobility compensation value, wherein a difference between the target mobility compensation value and the preset mobility compensation value is less than a threshold, and wherein the threshold is zero;

wherein the compensation circuit is further configured to, based on the target mobility compensation value, when the display panel is in a non-display state, compensate a mobility of the driving transistor in a preset compensation manner;

wherein the pixel circuit includes: an input transistor, a driving transistor, a sensing transistor, a first storage capacitor, a second storage capacitor and an organic light-emitting diode; a gate electrode of the input transistor is coupled to a first control signal line; a first electrode of the input transistor is coupled to a data signal line; a second electrode of the input transistor is coupled to a gate electrode of the driving transistor; a first electrode of the driving transistor is coupled to a power signal line; a second electrode of the driving transistor is coupled to an anode of the organic light-emitting diode; a cathode of the organic light-emitting diode is coupled to a ground signal line; a first terminal of the first storage capacitor is coupled to the gate electrode of the driving transistor; a second terminal of the first storage capacitor is coupled to the second electrode of the driving transistor; a first terminal of the second storage capacitor is coupled to the second electrode of the driving transistor; a second terminal of the second storage capacitor is coupled to the ground signal line; a gate electrode of the sensing transistor is coupled to a second control signal line; a first electrode of the sensing transistor is coupled to the second electrode of the driving transistor; a second electrode of the sensing transistor is coupled to a sensing signal line; and wherein the compensation circuit is further configured to, when the display panel is in the non-display state, control on-time of the sensing transistor according to the target mobility compensation value, thereby controlling charging time of the second storage capacitor.

8. The device according to claim 7, wherein the compensation circuit is further configured to, after compensating the mobility of the driving transistor in the preset compensation manner, when the display panel is in an actual display state, perform real-time compensation for the mobility of the driving transistor in the pixel circuit by compensating a data signal received by the pixel circuit.

9. The device according to claim 7, wherein the sensing circuit is further configured to, before the display panel is in the preset display state, enable the display panel to be in the non-display state, and sense an initial threshold voltage corresponding to the driving transistor in the pixel circuit;

the compensation circuit is further configured to obtain an initial compensation test signal according to the initial threshold voltage, and write the initial compensation test signal into the gate electrode of the driving transistor;

the sensing circuit is further configured to sense an initial mobility corresponding to the driving transistor;

the compensation circuit is further configured to obtain the initial mobility compensation value according to a preset standard mobility and the initial mobility.

10. The device according to claim 7, wherein the preset display state is a display state that simulates an actual display state, with working conditions when the display panel is in the preset display state being the same as working conditions when the display panel is in the actual display state;

the preset mobility compensation value represents a mobility compensation value that needs to be compensated for the driving transistor in the preset display state.

11. The device according to claim 7, wherein the non-display state includes a shutdown state; the shutdown state means that the display panel does not display images, but the pixel circuit in the display panel is in working state.

12. A pixel circuit compensation device for a pixel circuit applied to a display panel, comprising: a memory and an actuator; wherein the actuator is configured to execute following instructions stored in the memory:

when the display panel is in a preset display state, sensing a preset mobility compensation value corresponding to a driving transistor in the pixel circuit;

according to the preset mobility compensation value, adjusting an initial mobility compensation value corresponding to the driving transistor to a target mobility compensation value, wherein a difference between the target mobility compensation value and the preset mobility compensation value is less than a threshold, and wherein the threshold is zero;

based on the target mobility compensation value, when the display panel is in a non-display state, compensating a mobility of the driving transistor in a preset compensation manner;

wherein the pixel circuit includes: an input transistor, a driving transistor, a sensing transistor, a first storage capacitor, a second storage capacitor and an organic light-emitting diode; a gate electrode of the input transistor is coupled to a first control signal line; a first electrode of the input transistor is coupled to a data signal line; a second electrode of the input transistor is coupled to a gate electrode of the driving transistor; a first electrode of the driving transistor is coupled to a power signal line; a second electrode of the driving transistor is coupled to an anode of the organic light-emitting diode; a cathode of the organic light-emitting diode is coupled to a ground signal line; a first terminal of the first storage capacitor is coupled to the gate electrode of the driving transistor; a second terminal of the first storage capacitor is coupled to the second electrode of the driving transistor; a first terminal of the second storage capacitor is coupled to the second electrode of the driving transistor; a second terminal of the second storage capacitor is coupled to the ground signal line; a gate electrode of the sensing transistor is coupled to a second control signal line; a first electrode of the sensing transistor is coupled to the second electrode of the driving transistor; a second electrode of the sensing transistor is coupled to a sensing signal line; and wherein the actuator is further configured to execute following instructions stored in the memory: when the display panel is in the non-display state, controlling on-time of the sensing transistor according to the target mobility compensation value, thereby controlling charging time of the second storage capacitor.

13. The device according to claim 12, wherein the actuator is further configured to execute following instructions stored in the memory:

after compensating the mobility of the driving transistor in the preset compensation manner, when the display panel is in an actual display state, performing real-time compensation for the mobility of the driving transistor in the pixel circuit by compensating a data signal received by the pixel circuit.

14. The device according to claim 12, wherein if the initial mobility compensation value is greater than the target mobility compensation value, when the display panel is in the non-display state, reducing the on time of the sensing transistor and increasing the charging time of the second storage capacitor; or, if the initial mobility compensation value is less than the target mobility compensation value, when the display panel is in the non-display state, increasing the on time of the sensing transistor and reducing the charging time of the second storage capacitor.

15. The device according to claim 12, wherein the actuator is further configured to execute following instructions stored in the memory:

before the display panel is in the preset display state, enabling the display panel to be in the non-display state, and sensing an initial threshold voltage corresponding to the driving transistor in the pixel circuit;

obtaining an initial compensation test signal according to the initial threshold voltage;

writing the initial compensation test signal into the gate electrode of the driving transistor, and sensing an initial mobility corresponding to the driving transistor;

obtaining the initial mobility compensation value according to a preset standard mobility and the initial mobility.

16. The device according to claim 12, wherein the preset display state is a display state that simulates an actual display state, with working conditions when the display panel is in the preset display state being the same as working conditions when the display panel is in the actual display state;

the preset mobility compensation value represents a mobility compensation value that needs to be compensated for the driving transistor in the preset display state.

17. The device according to claim 12, wherein the non-display state includes a shutdown state; the shutdown state means that the display panel does not display images, but the pixel circuit in the display panel is in working state.

* * * * *